343-700 MS AU 256 EX
9/26/78 OR 4,117,489

United States Patent [19]

Kaloi

[11] 4,117,489

[45] Sep. 26, 1978

[54] CORNER FED ELECTRIC MICROSTRIP DIPOLE ANTENNA

[75] Inventor: Cyril M. Kaloi, Thousand Oaks, Calif.

[73] Assignee: The United States of America as represented by the Secretary of the Navy, Washington, D.C.

[21] Appl. No.: 871,573

[22] Filed: Jan. 23, 1978

Related U.S. Application Data

[63] Continuation-in-part of Ser. No. 571,152, Apr. 24, 1975, abandoned.

[51] Int. Cl.[2] ..... H01Q 1/38
[52] U.S. Cl. ..... 343/700 MS; 343/846
[58] Field of Search ..... 343/700 MS, 829, 830, 343/846

[56] References Cited

U.S. PATENT DOCUMENTS

| | | | |
|---|---|---|---|
| 3,921,177 | 11/1975 | Munson | 343/700 MS |
| 3,984,834 | 10/1976 | Kaloi | 343/700 MS |

*Primary Examiner*—Eli Lieberman
*Attorney, Agent, or Firm*—Richard S. Sciascia; Joseph M. St.Amand

[57] ABSTRACT

A corner fed electric microstrip dipole antenna consisting of a thin electrically conducting, preferably rectangular or square shaped radiating element formed on one surface of a dielectric substrate, the ground plane being on the opposite surface. The feed point is located at one corner of the antenna element and the input impedance is matched with a matching microstrip transmission feed line connected to the corner of the antenna. The length of the element determines the resonant frequency along the Y axis and the width determines the resonant frequency along the Z axis. This antenna is capable of generating circular polarized radiation using a single element and single feed point.

6 Claims, 23 Drawing Figures

XY PLANE PLOT
2212 MHz Eø

XZ PLANE PLOT
2212 MHz Eθ

Fig. 16.
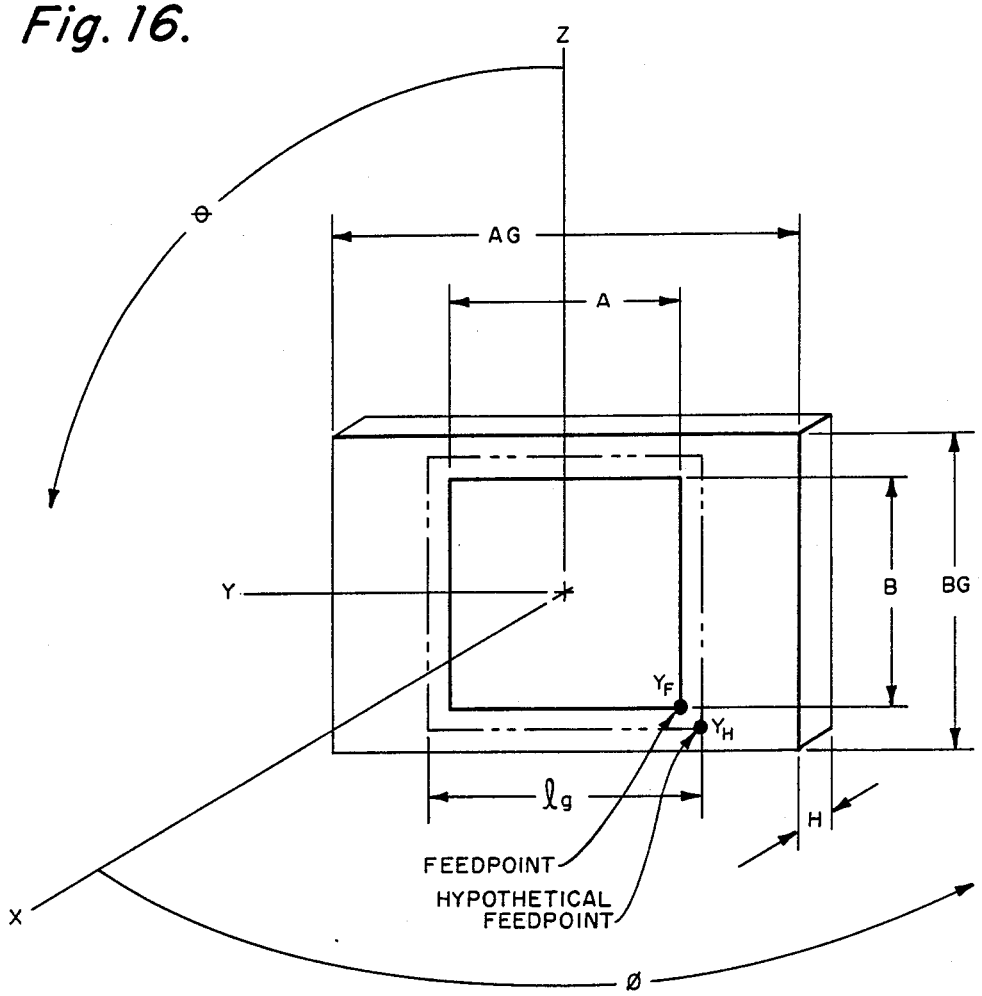
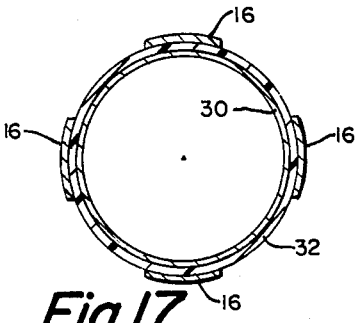
Fig. 17
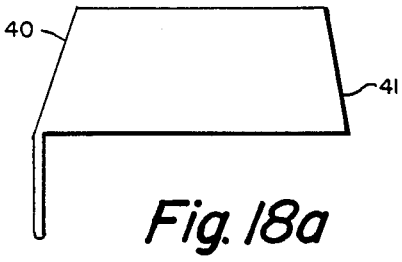
Fig. 18a
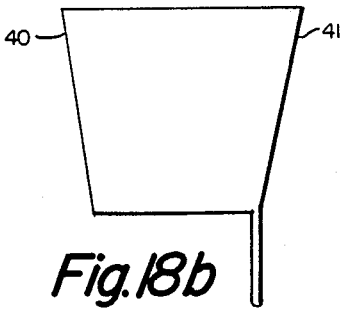
Fig. 18b
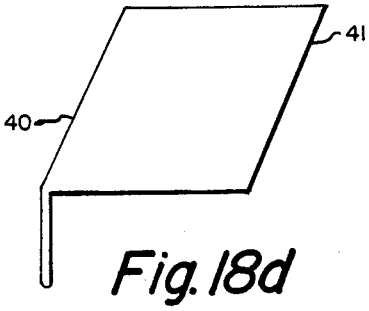
Fig. 18d
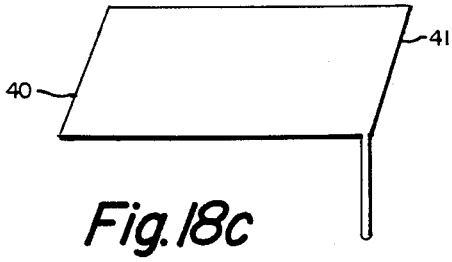
Fig. 18c

CORNER FED ELECTRIC MICROSTRIP DIPOLE ANTENNA

CROSS-REFERENCE TO RELATED APPLICATIONS

This invention is a continuation-in-part of U.S. patent application Ser. No. 571,152, filed Apr. 24, 1975, now abandoned, for CORNER FED ELECTRIC MICROSTRIP DIPOLE ANTENNA; and, is related to copending U.S. patent applications:

- Ser. No. 571,154 for DIAGONALLY FED MICROSTRIP DIPOLE ANTENNA, now U.S. Pat. No. 3,984,834;
- Ser. No. 571,156 for END FED MICROSTRIP QUADRUPOLE ANTENNA, now U.S. Pat. No. 3,972,050;
- Ser. No. 571,155 for COUPLED FED MICROSTRIP DIPOLE ANTENNA, now U.S. Pat. No. 3,978,487;
- Ser. No. 571,157 for OFFSET FED MICROSTRIP DIPOLE ANTENNA, now U.S. Pat. No. 3,978,488;
- Ser. No. 571,153 for NOTCH FED MICROSTRIP DIPOLE ANTENNA, now U.S. Pat. No. 3,947,850;
- Ser. No. 571,158 for ASYMMETRICALLY FED ELECTRIC MICROSTRIP DIPOLE ANTENNA, now U.S. Pat. No. 3,972,049;

all filed together on Apr. 24, 1975 by Cyril M. Kaloi along with U.S. patent application Ser. No. 571,152 for CORNER FED ELECTRIC MICROSTRIP DIPOLE ANTENNA. This invention is also related to copending U.S. patent applications:

- Ser. No. 712,994 for MULTIPLE FREQUENCY MICROSTRIP ANTENNA ASSEMBLY, filed Aug. 9, 1976, now U.S. Pat. No. 4,074,270;
- Ser. No. 740,690 for NOTCH FED TWIN ELECTRIC MICROSTRIP DIPOLE ANTENNAS, filed Nov. 10, 1976, now U.S. Pat. No. 4,072,951; and
- Ser. No. 740,694 for ELECTRIC MONOMICROSTRIP DIPOLE ANTENNAS, filed Nov. 10, 1976, now U.S. Pat. No. 4,083,046;

by Cyril M. Kaloi. The above mentioned applications are all commonly assigned.

BACKGROUND OF THE INVENTION

This invention relates to antennas and more particularly to a low physical profile antenna that can be arrayed to provide near isotropic radiation patterns.

In the past, numerous attempts have been made using stripline antennas to provide an antenna having ruggedness, low physical profile, simplicity, low cost, and conformal arraying capability. However, problems in reproducibility and prohibitive expense made the use of such antennas undesirable. Older type antennas could not be flush mounted on a missile or airfoil surface. Slot type antennas required more cavity space, and standard dipole or monopole antennas could not be flush mounted.

SUMMARY OF THE INVENTION

The present antenna is one of a family of new microstrip antennas and uses a very thin laminated structure which can readily be mounted on flat or curved irregular structures, presenting low physical profile where minimum aerodynamic drag is required. The specific type of microstrip antenna described herein is the "corner fed electric microstrip dipole." This antenna can be arrayed with interconnecting microstrip feedlines as part of the element. Therefore, the antenna element and the feedlines can be photo etched simultaneously on a dielectric substrate. Using this technique, only one coaxial-to-microstrip adapter is required to interconnect an array of these antennas with a transmitter or receiver. Circular polarization is obtainable in a single corner fed element with the use of a single coaxial-to-microstrip adapter.

Reference is made herein to the "electric microstrip dipole" instead of simply the "microstrip dipole" to differentiate between two basic types; the first being the electric microstrip type, and the second being the magnetic microstrip type. The corner fed electric microstrip dipole antenna belongs to the electric microstrip type antenna. The electric microstrip antenna consists essentially of a conducting strip called the radiating element and a conducting ground plane separated by a dielectric substrate. The length of the radiating element is approximately $\frac{1}{2}$ wavelength. The width may be varied depending on the desired electrical characteristics. The conducting ground plane is usually much greater in length and width than the radiating element.

The magnetic microstrip antenna's physical properties are essentially the same as the electric microstrip antenna, except the radiating element is approximately $\frac{1}{4}$ the wavelength and also one end of the element is grounded to the ground plane.

The thickness of the dielectric substrate in both the electric and magnetic microstrip antenna should be much less than $\frac{1}{4}$ the wavelength. For thickness approaching $\frac{1}{4}$ the wavelength, the antenna radiates in a monopole mode in addition to radiating in a microstrip mode.

The antenna as hereinafter described can be used in missiles, aircraft and other type applications where a low physical profile antenna is desired. The present type of antenna element provides completely different radiation patterns and can be arrayed to provide near isotropic radiation patterns for telemetry, radar, beacons, tracking, etc. By arraying the present antenna with several elements, more flexibility in forming radiation patterns is permitted. In addition, the antenna can be designed for any desired frequency within a limited bandwidth, preferably below 25 GHz, since the antenna will tend to operate in a hybrid mode (i.e., microstrip/-monopole mode) above 25 GHz for most stripline materials commonly used. However, for clad materials thinner than 0.031 inch higher frequencies can be used. The design technique used for this antenna provides an antenna with ruggedness, simplicity, low cost, a low physical profile, and conformal arraying capability about the body of a missile or vehicle where used including irregular surfaces, while giving excellent radiation coverage. The antenna can be arrayed over an exterior surface without protruding, and be thin enough not be affect the airfoil or body design of the vehicle. The thickness of the present antenna can be held to an extreme minimum depending upon the bandwidth requirement; antennas as thin as 0.005 inch for frequencies above 1,000 MHz have been successfully produced. Due to its conformability, this antenna can be applied readily as a wrap around band to a missile body without the need for drilling or injuring the body and without interfering with the aerodynamic design of the missile, and arrayed about the missile body, etc., to provide near isotropic radiation. In the present type antenna, the antenna element is not grounded to the ground plane. Further, the antenna can be easily matched to most practical impedances with a matching microstrip network connected to the feed point at a corner of the element.

The corner fed electric microstrip dipole antenna consists of a thin electrically-conducting, rectangular-shaped element formed on the surface of a dielectric substrate; the ground plane is on the opposite surface of the dielectric substrate. The antenna is usually fed from a microwave-to-microstrip adapter connected to a matching microstrip network which in turn is connected to one corner of the antenna element, with the center pin of the adapter extending through the ground plane and dielectric substrate to the matching network. The feed point is located at the corner of the antenna element. The antenna bandwidth increases with the width of the element and the spacing (i.e., thickness of dielectric between the ground plane and the element; the spacing has a somewhat greater effect on the bandwidth than the element width. The radiation pattern changes very little within the bandwidth of operation.

Design equations sufficiently accurate to specify the important design properties of the corner fed electric dipole antenna are also included below. These design properties are the input impedances, the gain, the bandwidth, the efficiency, the polarization, the radiation pattern, and the antenna element dimensions as a function of the frequency. The design equations for this type antenna and the antennas themselves are new.

BRIEF DESCRIPTION OF THE DRAWINGS

FIG. 16 is an illustration of the alignment coordinate system, as in FIG. 1, but also showing an hypothetical feedpoint located beyond the corner of the element for the purpose of discussing circular polarization.

FIG. 17 illustrates a typical substantially cylindrical array of radiating elements for providing a near isotropic radiation pattern.

FIGS. **18*a* through 18*d*** show various forms of trapezoidal and parrallelogram shaped radiating elements, the oblique sides of which operate to advance or retard one mode of current oscillation with respect to the other mode of current oscillation.

DESCRIPTION AND OPERATION

Figure 1:
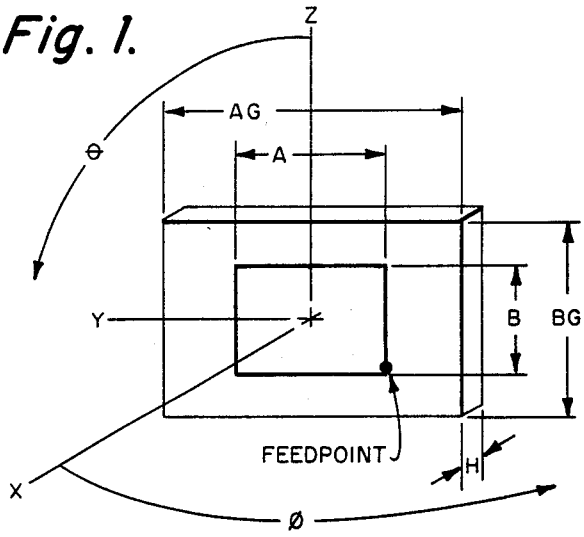
FIG. 1 illustrates the alignment coordinate system used for the corner fed electric microstrip dipole antenna.

The coordinate system used and the alignment of the antenna element within this coordinate system are shown in FIG. 1. The coordinate system is in accordance with the IRIG Standards and the alignment of the antenna element was made to coincide with the actual antenna patterns that will be shown later. The B dimension is the width of the antenna element. The A dimension is the length of the antenna element. The H dimension is the height of the antenna element above the ground plane and also the thickness of the dielectric. The AG dimension and the BG dimension are the length and the width of the ground plane, respectively. The angles $\theta$ and $\phi$ are measured per IRIG standards. The above parameters are measured in inches and degrees.

Figure 2A:
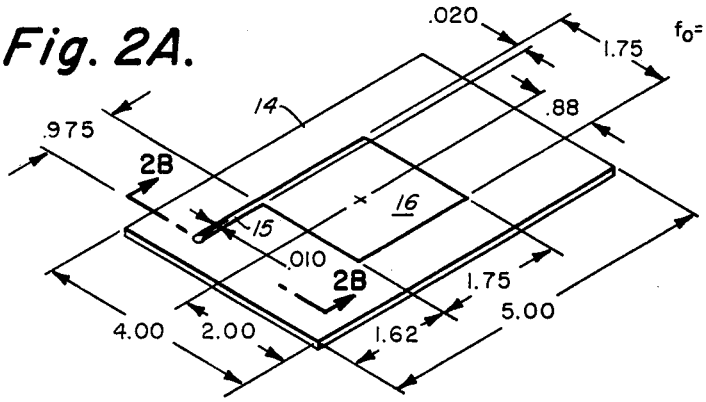
FIG. 2A is an isometric planar view of a typical square corner fed electric microstrip dipole antenna.
Figure 2B:
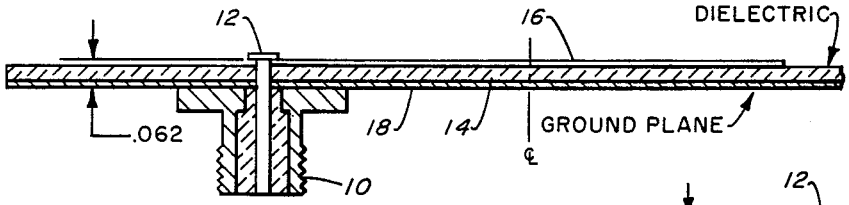
FIG. 2B is a cross-sectional view taken along line B—B of FIG. 2A.
Figure 3B:
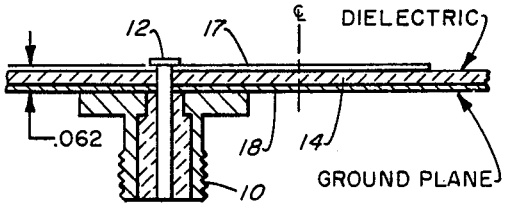
FIG. 3B is a cross-sectional view taken along section line B—B of FIG. 2A.
Figure 3A:
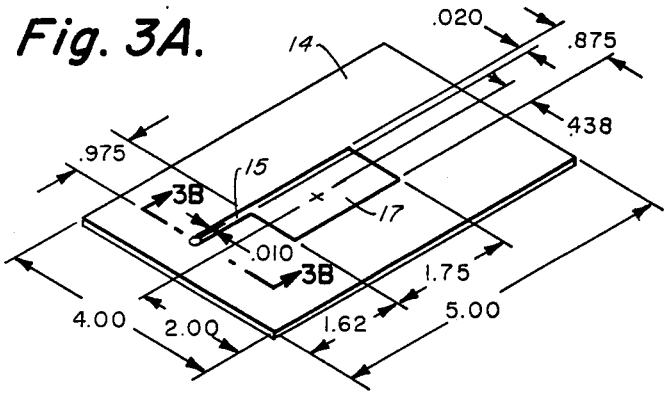
FIG. 3A is an isometric planar view of a typical rectangular corner fed electric microstrip dipole antenna.

FIGS. 2A and 2B show a typical square corner fed electric microstrip dipole antenna of the present invention. FIGS. 3A and 3B show a typical rectangular corner fed electric microstrip dipole antenna. Two typical antennas are illustrated with the dimensions given in inches as shown in FIGS. 2A and 2B, and 3A and 3B, by way of example, and the curves shown in later figures are for the typical antennas illustrated. The antenna is fed from a coaxial-to-microstrip adapter 10, with the center pin 12 of the adapter extending through the dielectric substrate 14 to a matching microstrip transmission line 15 connected to the feed point on the corner of microstrip element 16 or 17. The microstrip antenna can be fed with most of the different types of coaxial-to-microstrip launchers presently available. The dielectric substrate 14 separates the element 16 or 17 from the ground plane 18 electrically.

If the corner fed electric microstrip dipole element is fed at the corner directly from the adapter, the input impedance for most practical antenna elements will usually be high compared to most source impedances. In such cases, a matching microstrip transmission line 15 is used to match the element to the lower source impedances as shown in FIGS. 2A and 3A. FIG. 2A shows such an arrangement for a square element 16. FIG. 3A shows a corner fed electric microstrip dipole with a rectangular element 17 also matched with a microstrip transmission line 15.

The square element 16, such as shown in FIGS. 2A and 2B, is the limit as to how wide the element can be, without exciting higher order modes of oscillation. The copper loss in the clad material determines how narrow the element can be made.

Figure 14:
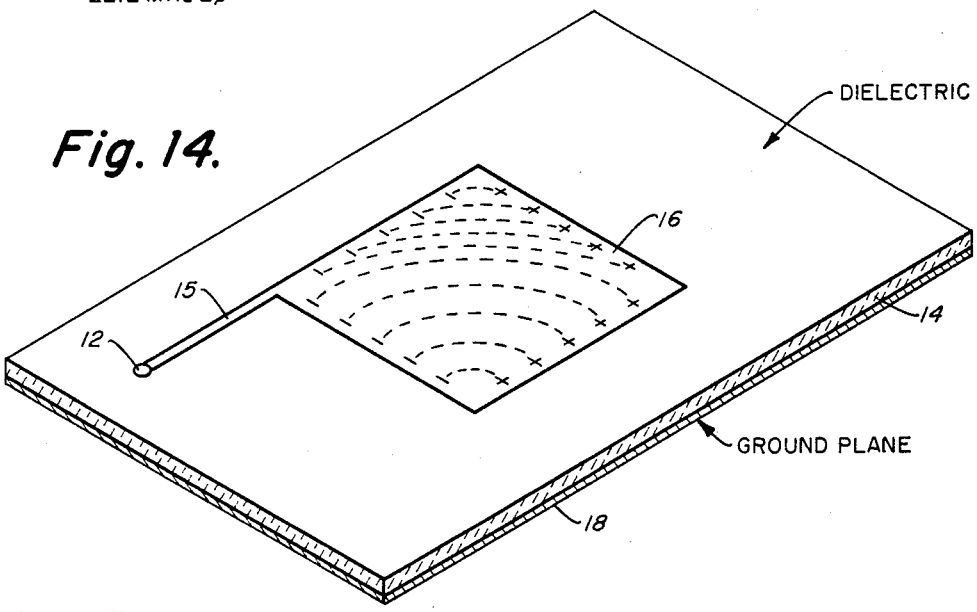
FIG. 14 illustrates the general configuration of the near field radiation for a corner fed square antenna where the resonant frequencies will be the same.

The square corner fed microstrip electric dipole, such as shown in FIG. 2A, operates in a degenerate mode, i.e., two oscillation modes occurring at the same frequency. These oscillations occur along the Y axis and also along the Z axis (see FIG. 1). Dimension A determines the resonant frequency along the Y axis and dimension B determines the resonant frequency along the Z axis. If the element is a perfect square, the resonant frequencies are the same and the phase difference between these two oscillations are zero. For such case, the resultant electric field vector is along the diagonal and in line with the feed corner, such as shown in FIG. 14.

Figure 4:
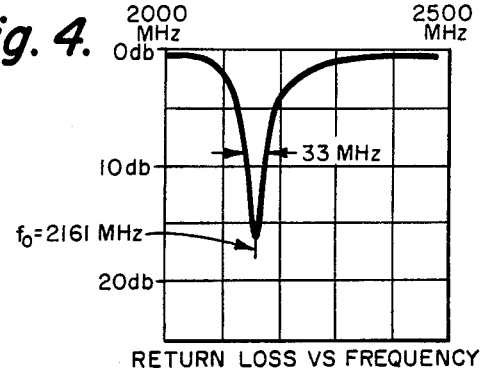
FIG. 4 is a plot showing the return loss versus frequency for a square element antenna having the dimensions shown in FIGS. 2A and 2B.
Figure 5:
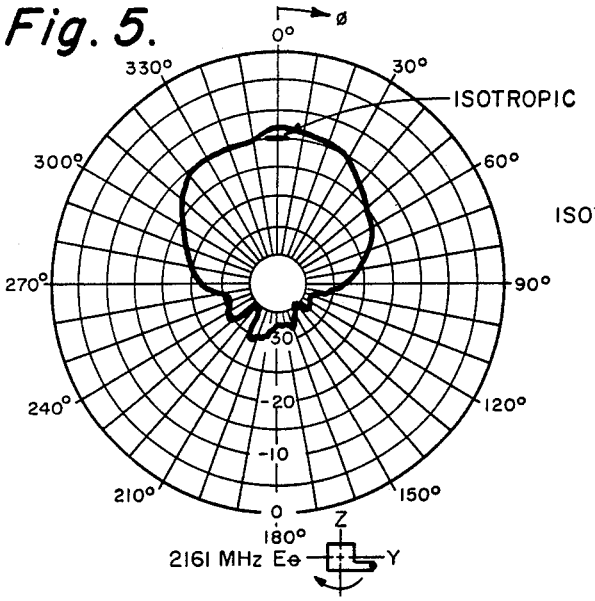
FIGS. 5 and 6 show antenna radiation patterns (XY-Plane plot) for the square element antenna shown in FIGS. 2A and 2B.
Figure 6:
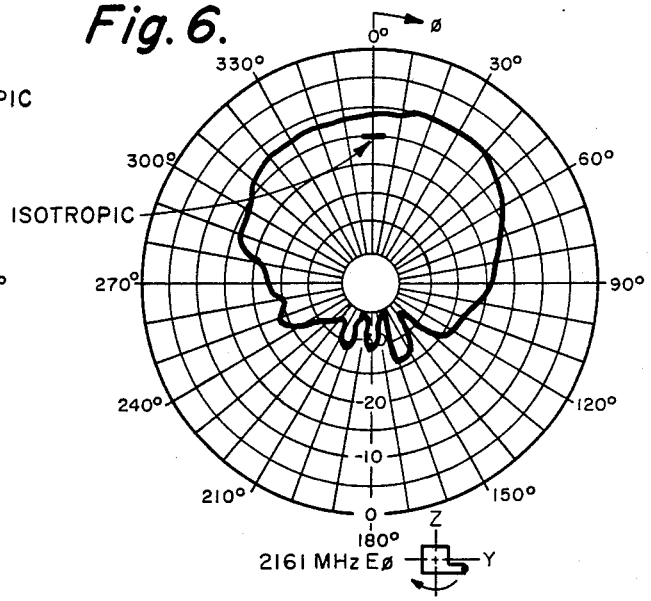
Figure 7:
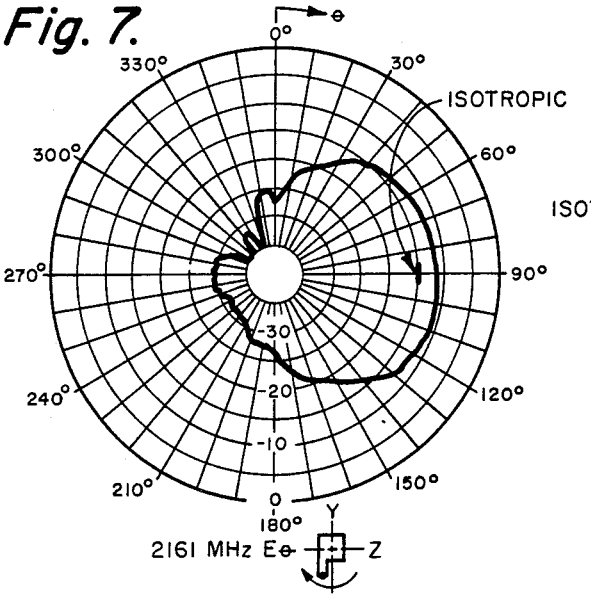
FIGS. 7 and 8 show antenna radiation patterns (XZ-Plane plot) for the square element antenna shown in FIGS. 2A and 2B.
Figure 8:
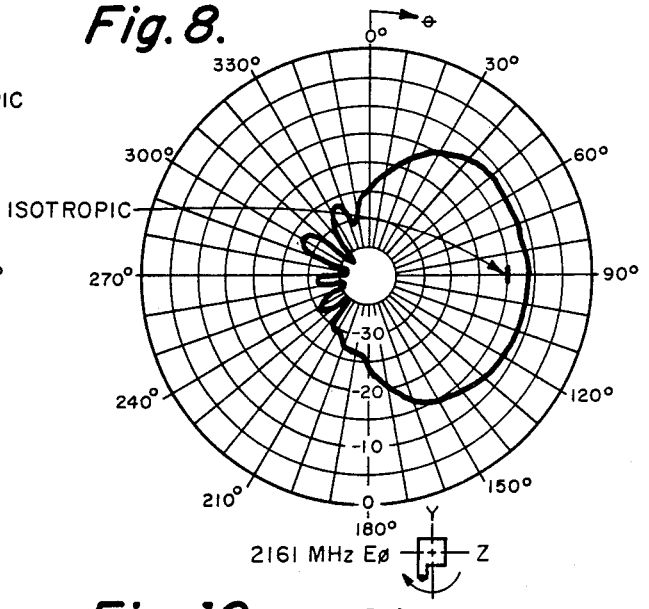
Figure 9:
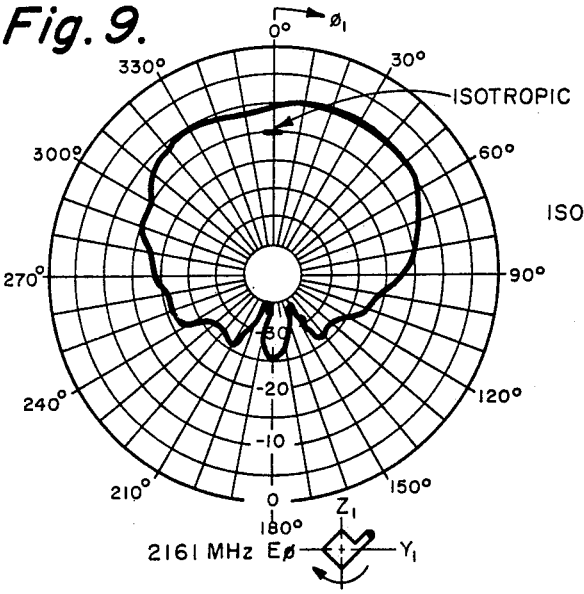
FIGS. 9 and 10 show antenna radiation patterns for both diagonals for the square element antenna shown in FIGS. 2A and 2B.
Figure 10:
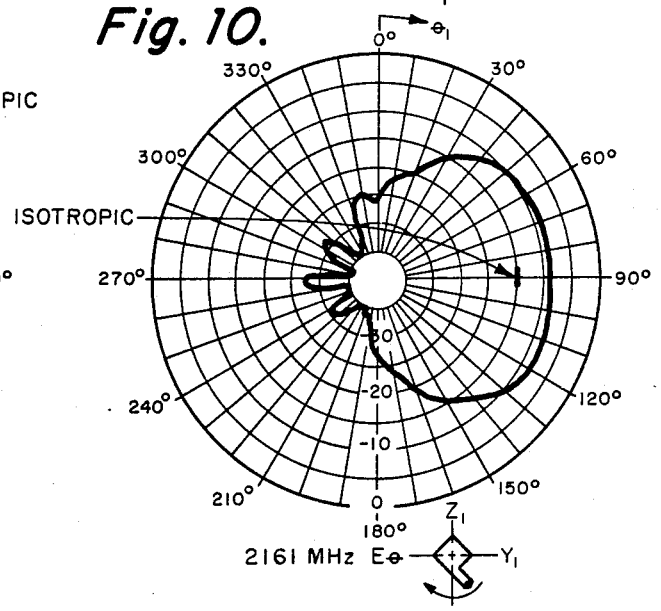

Mode degeneracy in a perfectly square element is not detrimental. The only apparent change is that the polarization is linear along the diagonal and in line with the feed corner, instead of in line with the oscillations. All other properties of the antenna remain as if oscillation is taking place in one mode only and this is shown by means of FIGS. 4 through 10. FIG. 4 shows a plot of return loss versus frequency for the square element of FIGS. 2A and 2B. FIG. 5 and FIG. 6 show radiation plots for the XY-Plane. FIG. 7 and FIG. 8 show radiation plots for the XZ-Plane. FIG. 9 and FIG. 10 show radiation plots for both diagonals. Radiation cross-polarization plots in the diagonal planes showed minimal energy and therefore are not illustrated.

If the B dimension is slightly smaller than the A dimension, a phase difference occurs between the two modes of oscillation. This can cause a circular polarization to occur. This circular polarization is very desirable in some applications, particularly when this is obtainable with the use of a single coaxial-to-microstrip adapter and no phase shifters. Circular polarization is discussed below.

Figure 11:
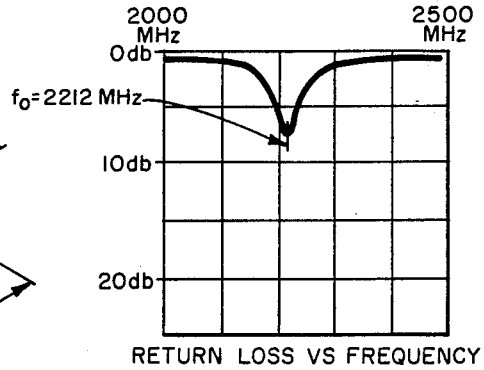
FIG. 11 is a plot showing the return loss versus frequency for a rectangular element antenna having the dimensions as shown in FIGS. 3A and 3B.
Figure 12:
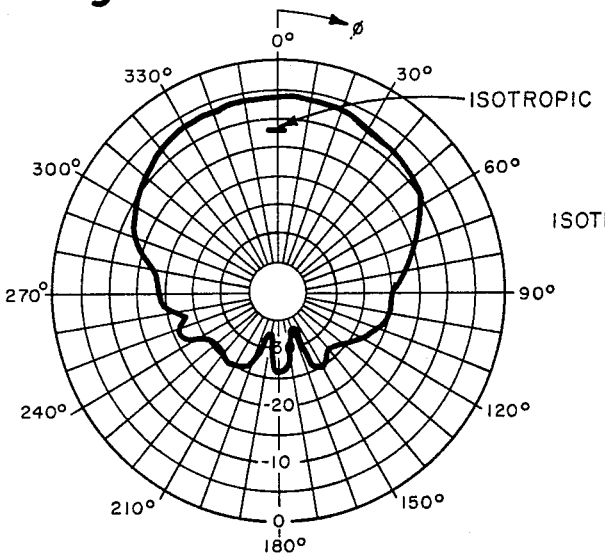
FIGS. 12 and 13 show the antenna radiation patterns (XY-Plane plot and XZ-Plane plot) for the rectangular element antenna shown in FIGS. 3A and 3B.
Figure 13:
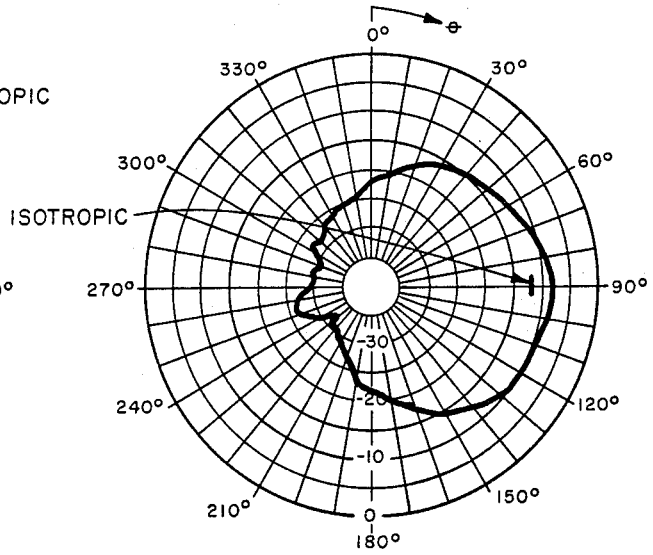

As the B dimension approaches $\lambda_g/4$ ($\lambda_g$ = guide wavelength) or smaller, the polarization becomes linear along the A dimension. In such case, oscillation takes place along the Y dimension and this is shown by FIG. 11 through FIG. 13. FIG. 11 shows a plot of return loss versus frequency for this form factor, such as for the rectangular antenna shown in FIGS. 3A and 3B. FIG. 12 and FIG. 13 show radiation plots for the antenna of FIGS. 3A & 3B where the polarization becomes linear along the A dimension. Only E-Plane plots (XY-Plane) and H-Plane plots (XZ-Plane) are shown. Cross polarization energy were minimal and therefore not included.

The copper losses in the clad material determine how narrow the element can be made because the amount of energy lost in the clad material can become greater than the energy radiated. The length of the element determines the resonant frequency of the antenna, about which more will be mentioned later. It is preferred that both the length and the width of the ground plane be at least one wavelength ($\lambda$) in dimension beyond each edge of the element to minimize backlobe radiation.

A typical near field radiation configuration, when the antenna is square and fed at the corner of the antenna element as in FIG. 2A, is shown in FIG. 14. In the corner fed microstrip dipole antenna there are two modes of current oscillation (i.e., a vertical current oscillation mode and a horizontal current oscillation mode) orthogonal to one another. Depending on the input impedance of each of these current modes, the radiation field distribution may change from diagonal fields to circulating fields.

Figure 15:
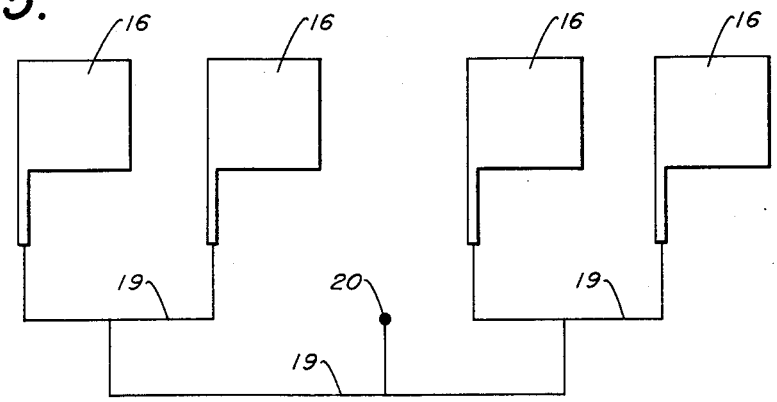
FIG. 15 shows a general arraying configuration using several antenna elements.

A plurality of microstrip antenna elements 16 can be arrayed on the dielectric substrate 14 by using microstrip transmission line 19, such as diagrammatically illustrated in FIG. 15, and fed from a single coaxial-to-microstrip connector at 20, and in turn wrapped about a vehicle body. A near isotropic radiation pattern can be produced by arraying a plurality of radiating elements such as shown in FIG. 15 in phase about a cylindrical ground plane. FIG. 17, for example, shows in cross-section, a cylindrical ground plane 30 spaced apart from a plurality of radiating elements 16 by dielectric substrate 32. Radiating elements 16 are positioned about the cylinder and arrayed with stripline or microstrip transmission line in a similar manner to that shown in FIG. 15. Any of the various antennas discussed herein can be arrayed in this general manner about a cylindrical or other shaped surface as a wraparound type of microstrip antenna.

Since the design equations for this type of antenna are new, pertinent design equations that are sufficient to characterize this type of antenna are therefore presented.

Design equations for the corner fed microstrip antenna are subject to change with slight variation in the antenna element dimension. This is particularly true with the antenna gain, antenna radiation pattern, antenna bandwidth and the antenna polarization. For this reason, the combined radiation fields are not presented.

It is much easier to understand the operation of the corner fed antenna if the A mode of oscillation properties are presented first and where applicable related to the B mode of oscillation.

Before determining the design equations for the A mode of oscillation the following statements are given:

1. The A mode of oscillation and the B mode of oscillation are orthogonal to one another and as such the mutual coupling is minimum.
2. If both the A mode of oscillation and the B mode of oscillation have the same properties, one-half of the available power is coupled to the A mode and one-half is coupled to the B mode of oscillation.
3. The combined input impedance is the parallel combination of the impedance of the A mode of oscillation and the B mode of oscillation.
4. Since the A mode of oscillation is orthogonal to the B mode of oscillation, the properties of each mode of oscillation can be determined independently of each other and a few of the combined properties can be determined in the manner prescribed above.
5. It is emphasized again that only a slight change in the element dimension will cause a large change in some of the antenna properties. For example, it will be shown later that less than 0.5% change in the element dimension can cause the polarization to change from linear along the diagonal to near circular.

Design Equations

The design equations will be obtained for the A mode of oscillation. In most cases, the equations obtained for the A mode of oscillation apply also to the B mode of oscillation since the A dimension is assumed to be equal to the B dimension for a square radiating element as in FIG. 2A.

Antenna Element Dimension

The equation for determining the length of the antenna element when $A = B$ is given by $$A = [1.18 \times 10^{10} - F \times 4 \times H \times \sqrt{\epsilon}]/[2 \times F \times \sqrt{1 + 0.61 \times (\epsilon - 1) \times (A/H)^{0.1155}}] \quad (1)$$

where $x$ = indicates multiplication $F$ = center frequency (Hz)

$\epsilon$ = the dielectric constant of the substrate (no units).

In most practical applications, F, H, and $\epsilon$ are usually given. As seen from equation (1), a closed form solution is not possible for the square element. However, numerical solution can be accomplished by using Newton's Method of Successive Approximation (see U.S. National Bureau of Standards, Handbook of Mathematical Functions, Applied Mathematics Series 55, Washington, D.C., GPO, November 1964) for solving equation (1) in terms of B when B is a function of A. Equation (1) is obtained by fitting curves to Sobol's equation (Sobol, H. "Extending IC Technology to Microwave Equipment," ELECTRONICS, Vol. 40, No. 6, Mar. 20, 1967, pages 112–124). The modification was needed to account for end effects when the microstrip transmission line is used as an antenna element. Sobol obtained his equation by fitting curves to Wheeler's conformal mapping analysis (Wheeler, H. "Transmission Line Properties of Parallel Strips Separated by a Dielectric Sheet," IEEE TRANSACTIONS, Microwave Theory Technique, Vol MTT-13, No. 2, March 1965, pp. 172–185).

Radiation Pattern

The radiation patterns for the $E_{\theta_A}$ field and the $E_{\phi_A}$ field are usually power patterns, i.e., $|E_{\theta_A}|^2$ and $|E_{\phi_A}|^2$, respectively.

The electric field for the corner fed dipole is given by $$E_{\theta_A} = \frac{jI_m Z_{o_A} e^{-jkr}}{\sqrt{2} \times 2\lambda r} [U \times \cos\phi + T \times \sin\theta] \quad (2)$$

and $$E_{\theta_A} = \frac{jI_m Z_{o_A} e^{-jkr}}{\sqrt{2} \times 2\lambda r} [U \times \sin\phi \cos\theta] \quad (3)$$

where $U = (U2 - U3)/U5$
$T = (T3 - T4)/T8$
$U2 = P \sin(A \times P/2) \cos(k \times A \times \sin\theta \sin\phi/2)$
$U3 = k \sin\theta \sin\phi \cos(A \times P/2) \sin(k \times A \times \sin\theta \sin\phi/2)$
$U5 = (P^2 - k^2 \sin^2\theta \sin^2\phi)$
$T3 = P \sin(P \times B/2) \cos(k \times B \times \cos\theta/2)$
$T4 = k \cos\theta \cos(P \times B/2) \sin(k \times B \times \cos\theta/2)$
$T8 = (P^2 - k^2 \cos^2\theta)$
$\lambda$ = free space wave length (inches)
$\lambda_g$ = waveguide wavelength (inches) and $\lambda_g = 2 \times A + (4 \times H/\sqrt{\epsilon})$
$j = (\sqrt{-1})$
$I_m$ = maximum current (amps)
$P = 2\pi/\lambda_g$, $k = 2\pi/\lambda$
$e$ = base of the natural log
$r$ = the range between the antenna and an arbitrary point in space (inches)
$Z_{O_A}$ = characteristic impedance of the element (ohms)
and $Z_{O_A}$ is given by $$Z_{o_A} = \frac{377 \times H}{\sqrt{\epsilon} \times B \times [1 + 1.735(\epsilon^{-0.0724})(H/B)^{0.836}]}$$

Therefore $$|E_{\phi_A}|^2 = \frac{I_m^2 Z_o^2}{8\lambda^2 r^2} [U \times \cos\phi + T \times \sin\theta]^2 \quad (4)$$

and

-continued $$|E_{\theta_A}|^2 = \frac{I_m^2 Z_o^2}{8\lambda^2 r^2} [U \times \sin\phi \cos\theta]^2 \quad (5)$$

Since the gain of the antenna will be determined later, only relative power amplitude as a function of the aspect angles is necessary. Therefore, the above equations may be written as $$|E_{\phi_A}|^2 = \text{Const} \times [U \times \cos\phi + T \times \sin\theta]^2 \quad (6)$$

and $$|E_{\theta_A}|^2 = \text{Const} \times [U \times \sin\phi \cos\theta]^2 \quad (7)$$

The above equations for the radiation patterns are approximate since they do not account for the ground plane effects. Instead, it is assumed that the energy emanates from the center and radiates into a hemisphere only. This assumption, although oversimplified, facilitates the calculation of the remaining properties of the antenna. However, a more accurate computation of the radiation pattern can be made.

Radiation Resistance

Calculation of the radiation resistance entails calculating several other properties of the antenna. To begin with, the time average Poynting Vector is given by $$P_{av_A} = R_e(\overline{E} \times \overline{H}^*)/2 = (|E_{\theta_A}|^2 + |E_{\phi_A}|^2)/(2 \times Z_{o_A}) \quad (8)$$

where

* indicates the complex conjugate when used in the exponent
$R_e$ means the real part and
$X$ indicates the vector cross product.

$$P_{av_A} = \frac{Z_{o_A} I_m^2}{16\lambda^2 r^2} [U^2 \times \cos^2\phi + 2 \times T \times U \times \sin\theta \cos\phi + T^2 \times \sin^2\theta + U^2 \times \sin^2\phi \cos^2\theta] \quad (9)$$

The radiation intensity, $K_A$, is the power per unit solid angle radiated in a given direction and is given by $$K_A = r^2 \times P_{av_A} \quad (10)$$

The radiated power, W, is given by $$W = \int_0^{\pi} \int_{-\frac{\pi}{2}}^{\frac{\pi}{2}} K_A \times \sin\theta \, d\theta \, d\phi \quad (11)$$

The radiation resistance, $R_{a_A}$, is given by $$R_{a_A} = \frac{W}{I_{eff}^2} \quad (12)$$

where $$I_{eff} = \frac{I_{m_A}}{\sqrt{2}} \quad (13)$$

therefore $$R_{a_A} = \frac{2 \times W}{I_{m_A}^2} \quad (14)$$

$$R_{a_A} = \frac{Z_{o_A}}{8 \times \lambda^2} \int_o^{\pi} \int_{-\frac{\pi}{2}}^{\frac{\pi}{2}} [U^2 \times \cos^2 \phi + 2 \times T \times U \times \sin \theta \cos \phi + T^2 \times \sin^2 \theta + U^2 \times \sin^2 \phi \cos^2 \theta] \sin \theta \, d\theta \, d\phi \quad (15)$$

Numerical integration of the above equation can be easily accomplished using Simpson's Rule. The efficiency of the antenna can be determined from the ratio of the Q (quality factor) due to the radiation resistance and the Q due to all the losses in the microstrip circuit. The Q due to the radiation resistance, $Q_{R_A}$, is given by $$Q_{R_A} = (\omega \times L \times A)/(2 \times R_{a_A})$$

where $\omega = 2\pi F$ and $L$ is the inductance of a parallel-plane transmission line and can be found by using Maxwell's Emf equation, where it can be shown that $$L = Z_o/(F = \lambda_g)$$

and $$\lambda_g = 2 \times A + (4 \times H/\sqrt{\epsilon})$$

The Q due to the radiation resistance, $Q_{R_A}$, is therefore given by $$Q_{R_A} = (\pi \times Z_{o_A} \times A)/(\lambda_{g_A} \times R_{a_A})$$

The Q due to the copper losses, $Q_{c_A}$, is similarly determined.

$$Q_{c_A} = (\omega \times L \times A)/(2 \times R_{c_A})$$

where $R_{c_A}$ is the equivalent internal resistance of the conductor. Since the ground plane and the element are made of copper, the total internal resistance is twice $R_c$. $R_c$ is given by $$R_{c_A} = (R_s \times A/B) \text{ (ohm)}$$

where $R_s$ is the surface resistivity and is given by $$R_s = \sqrt{(\pi \times F \times \mu)/\sigma} \text{ (ohm)}$$

where $\sigma$ is the conductivity in mho/in. for copper and $\mu$ is the permeability in henry/in. $\sigma$ and $\mu$ are given by $$\sigma = 0.147 \times 10^7, \mu = 0.0319 \times 10^{-6}$$

Therefore, the Q is determined using the real part of the input impedance $$Q_{c_A} = (\pi \times Z_{o_A} \times B)/(\lambda_{g_A} \times R_s)$$

The loss due to the dielectric is usually specified as the loss tangent, $\epsilon$. The Q, resulting from this loss, is given by $$Q_{D_A} = 1/\delta$$

The total Q of the microstrip antenna is given by $$Q_{T_A} = \frac{1}{\frac{1}{Q_{R_A}} + \frac{1}{Q_{c_A}} + \frac{1}{Q_{D_A}}}$$

The efficiency of the microstrip antenna is given by $$eff = Q_{T_A}/Q_{R_A}$$

Bandwidth

The bandwidth of the microstrip antenna at the half power point is given by $$\Delta f = F/Q_{T_A}$$

The foregoing calculations of Q hold if the height, H, of the element above the ground plane is a small part of a waveguide wavelength, $\lambda_{g_A}$, where the waveguide wavelength is given by $$\lambda_{g_A} = 2 \times A + (4 \times H/\sqrt{\epsilon})$$

If H is a significant part of $\lambda_{g_A}$, a second mode of radiation known as the monopole mode begins to add to the microstrip mode of radiation. This additional radiation is not undesirable but changes the values of the different antenna parameters.

Gain

The directive gain is usually defined (H. Jasik, ed., Antenna, Engineering Handbook, New York McGraw-Hill Book Co., Inc., 1961, p. 3) as the ratio of the maximum radiation intensity in a given direction to the total power radiated per $4\pi$ steradians and is given by $$D_A = D_{max_A}/(W_A/4\pi)$$

The maximum value of radiation intensity, K, occurs when $0 = 90°$ and $\phi = 0°$. Evaluating K at these values at $\theta$ and $\phi$, we have $$K_A \Big|_{\phi = 0°}^{\theta = 90°} = K_{max_A}$$

$$K_{max_A} = \frac{Z_{o_A} I_{m_A}^2}{16\lambda^2 P^2} [\sin (AP/2) + \sin (BP/2)]^2$$

since $$W_A = (R_{a_A} \times I_{m_A}{}^2)/2$$

$$D_A = \frac{Z_{o_A} \times \pi}{2R_{a_A} \times \lambda^2 \times P^2} [\sin (AP/2) + \sin (BP/2)]^2$$

and for $A = B$ $$D_A = (2 \times Z_{o_A} \times A^2)/(R_{a_A} \times \lambda^2 \times \pi)$$

Typical calculated directive gains are 2.69 db. The gain of the antenna is given by $$G_A = D_A \times efficiency$$

Input Impedance

To determine the input impedance at any point along the diagonal of the corner fed microstrip antenna, the current distribution may be assumed to be sinusoidal. Furthermore, at resonance the input reactance at that point is zero. Therefore, the input resistance is given by $$R_{in} = \frac{2 \times Z_{o_A}^2 \times \sin^2(2\pi y_o/\lambda_{g_A})}{R_{t_A}}$$

Where $R_{t_A}$ is the equivalent resistance due to the radiation resistance plus the total internal resistance or $$R_{t_A} = R_{a_A} + 2R_{c_A}$$

The equivalent resistance due to the dielectric losses may be neglected.

The foregoing equations have been developed to explain the performance of the microstrip antenna radiators discussed herein and are considered basic and of great importance to the design of antennas in the future.

Antenna properties for the B mode can be determined in the same manner as given above for determining the properties for the A mode of oscillation. Since the A dimension equals the B dimension, the values obtained for the A mode are equal in most cases. Therefore:

$$Z_{o_A} = Z_{o_B}$$

$$R_{a_A} = R_{a_B}$$

$$Q_{R_A} = Q_{R_B}$$

$$Q_{c_A} = Q_{c_B}$$

$$Q_{T_A} = Q_{T_B}$$

$$\lambda_{g_A} = \lambda_{g_B}$$

$$G_A = G_B$$

$$R_{in(A)} = R_{in(B)}$$

$$R_{t(A)} = R_{t(B)}$$

Using the A mode equations for the B mode of oscillation saves rederiving similar equations.

In evaluating the combined properties of the corner fed antenna:

$$R_{in(A,B)} = \frac{1}{\frac{1}{R_{in(A)}} + \frac{1}{R_{in(B)}}}$$

The combined gain is given by $$G_{(A,B)} = G_{(A)} + G_{(B)}$$

The actual combined gain is normally evaluated at $K_{max(A,B)}$ which turns out to be $G_{(A)} + G_{(B)}$. The combined Q is given by $$Q_{T(A,B)} = \frac{1}{\frac{1}{Q_{T(A)}} + \frac{1}{Q_{T(B)}}}$$

and the combined radiation resistance is given by $$R_{a(A,B)} = \frac{1}{\frac{1}{R_{a(A)}} + \frac{1}{R_{a(B)}}}$$

When the microstrip antenna is fed in th corner, two modes of oscillation can occur. If dimension A is equal to dimension B and both are equal to the resonant length $l$ for a specific frequency, the oscillation along the A length (A mode) and the oscillation along the B length (B mode) will have the same amplitude of oscillation. In addition, the phase between the A mode of oscillation will be equal to the B mode of oscillation. In such case the polarization is linear.

If dimension A is made slightly shorter than the resonant length $l$ the input impedance for the A mode of oscillation will be inductive. This inductive impedance will have a retarding effect on the phase of the A mode of oscillation.

If dimension B is made slightly longer than the resonant length $l$, the input impedance for the B mode of oscillation will be capacitive. This capacitive impedance will have an advancing effect on the phase of the B mode of oscillation.

By definition, circular polarization can be obtained if there are two electric fields normal to one another, equal in amplitude and having a phase difference of 90°. In the case of the corner fed microstrip dipole antenna, the A mode of oscillation and the B mode of oscillation create fields normal to one another. As previously mentioned, the phase of one mode of oscillation can be advanced and the phase of another retarded. If there is enough retardation and enough advance in the fields, a 90° phase can be obtained. The equal amplitude in each of the fields can be obtained by coupling the same amount of power into each mode of oscillation. This will provide circular polarization.

Any variation of the phase of the above fields, or its amplitude will provide elliptical polarization (i.e., there must be some phase difference, but not necessarily amplitude difference). Varying the dimensions of the radiating element only slightly from the square form (where the length A is equal to the width B and the polarization is linear) to that which will provide circular polarization requires only a very small dimensional change, as already mentioned above and shown in the design equations which follow. However, by making smaller incremental changes in the dimensions of the square linear polarized radiating element than required to obtain circular polarization, various degrees of elliptical polarization can be obtained. Moreover, in further reducing the width B as compared to the length A such that the length is substantially greater than the width, progression will be made from circular polarization through the various phases of elliptical polarization to substantially linear polarization. Such as radiating element having a length substantially greater than the width is shown in FIG. 3A. AS one can observe, the incremental difference between the width and the length while progressing from a square (linear polarized) radiating element to a slightly less than square (circularly polarized) radiating element is much less than the progression from the slightly less than square circularly polarized case to a rectangular radiating element of dimensions where the length is substantially greater than the width (as in FIG. 3A) providing linear polarization. Various phases of elliptical polarization are also provided by the incremental changes in dimensions from the slightly less than square circularly polarized form of radiating element to the rectangular form where the length is substantially greater than the width. In other words, circular polarization in a corner fed microstrip antenna can be approached from either direction, either from the linear polarized square or from the linear polarized rectangular form, one approach requiring extremely small incremental changes and the other approach requiring large incremental changes for the various respective degrees of elliptical polarization between either of the linear polarized forms and the circularly polarized form. Circular polarization, however, is a very special form of polarization.

Elliptical polarization is the most general form of polarization. Both circular and linear polarizations are special cases of elliptical polarization. In the corner fed antenna, circular polarization can only be obtained when both the A mode of oscillation and the B mode of oscillation have equal amplitude at 90° phase difference. For linear polarization, it is only necessary to have both phases equal.

Design equations for obtaining circular polarization in the corner fed microstrip antenna can be obtained by using transmission line theory. To begin with the input impedance for an open circuited transmission line is given by:

$$Z_S = Z_o \frac{\mathrm{Cosh}\alpha l\ \mathrm{Cos}\beta l + j\ \mathrm{Sinh}\alpha l\ \mathrm{Sin}\beta l}{\mathrm{Sinh}\alpha l\ \mathrm{Cos}\beta l + j\ \mathrm{Cosh}\alpha l\ \mathrm{Sin}\beta l} \tag{16}$$

If both the A mode of oscillation and the B mode of oscillation are analyzed, equation (1) can be rewritten for the A mode as $$Z_{S_A} = Z_{o_A} \frac{\mathrm{Cosh}\alpha_A l_A\ \mathrm{Cos}\beta l_A + j\ \mathrm{Sinh}\alpha_A l_A\ \mathrm{Sin}\beta l_A}{\mathrm{Sinh}\alpha_A l_A\ \mathrm{Cos}\beta l_A + j\ \mathrm{Sinh}\alpha_A l_A\ \mathrm{Sin}\beta l_A} \tag{17}$$

and for the B mode as $$Z_{S_B} = Z_{o_B} \frac{\mathrm{Cosh}\alpha_B l_B\ \mathrm{Cos}\beta l_B + j\ \mathrm{Sinh}\alpha_B l_B\ \mathrm{Sin}\beta l_B}{\mathrm{Sinh}\alpha_B l_B\ \mathrm{Cos}\beta l_B + j\ \mathrm{Sinh}\alpha_B l_B\ \mathrm{Sin}\beta l_B} \tag{18}$$

where $$\alpha_A = \frac{R_{t_A}}{A \times 2 \times Z_{o_A}}$$

$$\alpha_B = \frac{R_{t_B}}{B \times 2 \times Z_{o_B}}$$

$$\beta = \frac{2\pi}{\lambda_g}$$

$$\lambda_g = 2l + (4 \times H/\sqrt{\epsilon})$$

where $l$ is the resonant length for the frequency of interest. (It is not necessary to have the actual element A at resonance. The element may be cut to a non-resonant length and made to resonate with a reactive load, as discussed in more detail below.) If there is deviation from a square element $l$ is given by $$l = [1.18 \times 10^{10} - F \times 4 \times H \times \sqrt{\epsilon}]/[2 \times F \times \sqrt{1} + 0.61 \times (\epsilon - 1) \times (l/H)^{.1155}] \tag{19}$$

Since a closed form solution of $l$ is not possible, numerical solution can be accomplished by using Newton's Method of Successive Approximation when A and B dimensions are equal, then $A = B = l$. If the A dimension is to be made slightly longer and the B dimension is to be made slightly shorter:

$$A = l + \Delta l_A$$

and $$b = l - \Delta l_B$$

$$Z_{o_A} = \frac{377 \times H}{\sqrt{\epsilon} \times B \times [1 + 1.735(\epsilon^{-0.0724})\ (H/B)^{0.836}]}$$

$$Z_{o_B} = \frac{377 \times H}{\sqrt{\epsilon} \times A \times [1 + 1.735(\epsilon^{-0.0724})\ (H/A)^{0.836}]}$$

Equations (17) and (18) can be simplified when the element is cut to resonant frequency, F.

At resonant frequency $\beta l = n\pi$ where $n = 1, 2, 3 \ldots$, and $n$ determines the order of oscillation. In this case, the order of oscillation is the first order and $\beta l = \pi$.

When the resonant waveguide length, $l_g$, is made longer by $\Delta l_A$, then:

$$l_A = l_g + \Delta l_A$$

and $$\beta l_A = \frac{2\pi n}{\lambda_g}(l_g + \Delta l_A)$$

If $n = 1$, then $$\beta l_A = \frac{2\pi l_g}{\lambda_g} + \frac{2\pi \Delta l_A}{\lambda_g}$$

since $l_g = \frac{\lambda g}{2}$ $$\beta l_A = \pi + \frac{2\pi\ \Delta l_A}{\lambda_g}.$$

Under these conditions $$\mathrm{Cos}\ \beta l_A = -\mathrm{Cos}\frac{2\pi\ \Delta l_A}{\lambda_g}$$

$$\mathrm{Sin}\ \beta l_A = -\mathrm{Sin}\frac{2\pi\ \Delta l_A}{\lambda_g}$$

Equation (17) can be written as $$Z_{S_A} = Z_{o_A} \frac{\mathrm{Cosh}\alpha_A l_A\ \mathrm{Cos}\frac{2\pi\ \Delta l_A}{\lambda_g} + j\ \mathrm{Sinh}\alpha_A l_A\ \mathrm{Sin}\frac{2\pi\ \Delta l_A}{\lambda_g}}{\mathrm{Sinh}\alpha_A l_A\ \mathrm{Cos}\frac{2\pi\ \Delta l_A}{\lambda_g} + j\ \mathrm{Cosh}\alpha_A l_A\ \mathrm{Sin}\frac{2\pi\ \Delta l_A}{\lambda_g}}$$

for moderately high Q antennas, the second term in the numerator is small and may be neglected compared to the other terms. Under these conditions $$\mathrm{Cosh}\alpha_A l_A \approx 1,\ \mathrm{Sinh}\alpha_A l_A \approx \alpha_A l_A$$

$$\mathrm{Cos}\left(\frac{2\pi\Delta l_A}{\lambda_g}\right) \approx 1,\ \mathrm{Sin}\left(\frac{2\pi\Delta l_A}{\lambda_g}\right) \approx \frac{2\pi\Delta L_A}{\lambda_g}$$

Therefore, $Z_{S_A}$ may be written as $$Z_{S_A} = Z_{o_A} \frac{1}{\alpha_A l_A + j\frac{2\pi\ \Delta l_A}{\lambda_g}} \tag{20}$$

equation (18) can be simplified in a similar manner. In this case $$l_B = l_g - n\lambda_B$$

$$\beta l_A = \frac{n2\pi}{\lambda_g}(l_g - \Delta l_B)$$

if $n = 1$ $$\beta l_A = \frac{2\pi l_g}{\lambda_g} - \frac{2\pi\,\Delta l_B}{\lambda_g}$$

since $l_g = \frac{\lambda_g}{2}$ $$\beta l_A = \pi - \frac{2\pi\,\Delta l_B}{\lambda_g}$$

under these conditions $$\mathrm{Cos}\beta l_B = -\,\mathrm{Cos}\frac{2\pi\Delta l_B}{\lambda_g}$$

$$\mathrm{Sin}\beta l_B = +\,\mathrm{Sin}\frac{2\pi\Delta l_B}{\lambda_g}.$$

Equation (18) can be written as $$Z_{S_B} = Z_{o_B}\frac{-\,\mathrm{Cosh}\alpha_B l_B\,\mathrm{Cos}\frac{2\pi\Delta l_B}{\lambda_g} + j\,\mathrm{Sinh}\alpha_B l_B\,\mathrm{Sin}\frac{2\pi\Delta l_B}{\lambda_g}}{-\,\mathrm{Sinh}\alpha_B l_B\,\mathrm{Cos}\frac{2\pi\Delta l_B}{\lambda_g} + j\,\mathrm{Cosh}\alpha_B l_B\,\mathrm{Sin}\frac{2\pi\Delta l_B}{\lambda_g}}$$

for moderately high Q antennas, the second term in the numerator is small and may be neglected compared to the other terms. Therefore $$\mathrm{Cosh}\alpha_B l_B \simeq 1,\ \mathrm{Sinh}\alpha_B l_B \simeq \alpha_B l_B$$

$$\mathrm{Cos}\left(\frac{2\pi\Delta l_B}{\lambda_g}\right) \simeq 1,\ \mathrm{Sin}\left(\frac{2\pi\Delta l_A}{\lambda_g}\right) \simeq \frac{2\pi\Delta l_B}{\lambda_g}.$$

Therefore, $Z_{S_B}$ can be written as $$Z_{S_B} = Z_{o_B}\frac{1}{\alpha_B l_B - j\frac{2\pi\Delta l_B}{\lambda_g}} \tag{21}$$

For circular polarization, the following two conditions must be satisfied $$\tan^{-1}\left(\frac{2\pi\Delta l_A}{\alpha_A l_A \lambda_g}\right) + \tan^{-1}\left(\frac{2\pi\Delta l_B}{\alpha_B l_B \lambda_g}\right) = 90^\circ$$

and $$\alpha_A l_A = \alpha_B l_B$$

As can be observed, determination of $\Delta l_A$ and $\Delta l_B$ by manual computation is almost impossible. However, the problem can be solvable by use of a computer. A further reduction in the complexity of the problem is to assume $$\alpha_A \simeq \alpha_B$$

which is a good assumption when $$\Delta l_A << \lambda_{g/10}$$

and $$\Delta l_B << \lambda_{g/10}$$

For these conditions $$l_A \simeq l_B$$

Therefore $$\tan^{-1}\left(\frac{2\pi\,\Delta l_A}{\alpha_A l_A \lambda_g}\right) \simeq \tan^{-1}\left(\frac{2\pi\,\Delta l_B}{\alpha_B l_B \lambda_g}\right) \simeq 45^\circ$$

and $$\Delta l_A \simeq \Delta l_B \simeq \frac{\alpha_A l_A \lambda_g}{2\pi} \simeq \frac{\alpha_B l_B \lambda_g}{2\pi}$$

The foregoing discussion involves a hypothetical case, where the feed point is located beyond the corner of the element at feed point $Y_H$ in FIG. 16. The coordinate system shown in FIG. 16 is the same as described above in regard to FIG. 1.

Similar analysis is made for determining the conditions for circular polarization at any corner feedpoint $Y_F$ for a typical corner fed antenna.

The corner fed electric microstrip antenna can readily be arrayed with microstrip transmission line and can be linearly, elliptically, or circularly polarized using only a single feedpoint without the need for phase shifters.

As indicated above, it is not necessary to have the actual element length A at resonance. The element may be cut to a non-resonant length and made to resonate with a reactive load. The reactive load can be either capacitive or inductive and in some instances both types of loading can be used. One or more loading capacitors, such as tuning slugs placed within the dielectric substrate, can be used for tuning the antenna and changing the effective length of the radiating element without physically changing the length thereof. Examples of capacitive loading are shown and discussed in copending U.S. patent application Ser. No. 712,994. Loading tabs of various forms, such as a small appendage to the width or length, can also serve to provide a reactive load to the radiating element. Such an appendage can be either capacitive or inductive depending upon the form factor. Examples of microstrip loading tabs are shown and discussed in aforementioned copending U.S. patent applications Ser. No. 740,690 and Ser. No. 740,694. It should also be noted that by varying the dimension of only one side of a rectangular (including square) radiating element so as to result in a radiating element that has at least one side that is not orthogonal, the resulting shape of the radiating element having one side slanted (such as shown in cross-referenced U.S. Pat. No. 3,978,488) can also operate to vary the polarization from linear to circular, including elliptical polarization, depending upon the change in the dimensions affecting the degree of slant and the form factor. The radiating element can also be made trapezoidal in shape, for example, as shown in FIG. 18*a* or FIG. 18*b* by changing the dimension of one side, or a non-rectangular parallelogram shaped radiating element like those illustrated in FIG. 18*c* and 18*d* can be used, to change the polarization from linear to elliptical or circular form. The slanted edge or edges, i.e., oblique sides 40 and 41, to the radiating element (which extend beyond any rectangular portion thereof) can be considered as a type of loading tab or appendage, and such technique operates to advance or retard one mode of current oscillation with respect to the other mode of current oscillation to change the antenna polarization.

Obviously many modifications and variations of the present invention are possible in the light of the above teaching. It is therefore to be understood that within the scope of the appended claims the invention may be practiced otherwise than as specifically described.

What is claimed is:

1. A corner fed electric microstrip dipole antenna having low physical profile and conformal arraying capability, comprising:

a. a thin ground plane conductor;

b. a thin square radiating element spaced from said ground plane;

c. said radiating element being electrically separated from said ground plane by a dielectric substrate;

d. said radiating element having a feed point located at a single corner thereof;

e. the length and width of said radiating element being equal and determining the resonant frequency along the length and width, respectively, of said antenna;

f. the antenna bandwidth being variable with the width dimension of the radiating element and the spacing between said radiating element and said ground plane, said spacing between the radiating element and the ground plane having somewhat greater effect on the bandwidth than the element width, the physical length of said radiating element being changed accordingly with the width thereof to maintain a square radiating element as the physical width is changed to vary the bandwidth; and g. the polarization of said antenna being linear along the diagonal on which the feedpoint lies and the resonant frequencies being equal along both the length of the antenna and along the width of the antenna with zero phase difference between the two modes of oscillation.

2. An antenna as in claim 1 wherein the ground plane conductor is at least one wavelength long and one wavelength wide to minimize any possible backlobe radiation.

3. An antenna as in claim 1 wherein:

a. a matching microstrip transmission line is provided having one end thereof connected to the radiating element feed point; and b. said radiating element is operable to be fed from a coaxial-to-microstrip adapter via said matching microstrip transmission line, the center pin of said adapter extending through said ground plane and dielectric substrate to the other end of said matching microstrip transmission line.

4. An antenna as in claim 1 wherein a plurality of said radiating elements are arrayed about a substantially cylindrical body to provide a near isotropic radiation pattern.

5. An antenna as in claim 1 wherein the length of said radiating element is approximately ½ wavelength.

6. A square corner fed antenna as in claim 1 wherein said antenna operates in an degenerate mode, said radiating element oscillating in two orthogonal modes of current oscillation with the first mode being along the length and the second being made along the width thereof, the resonant frequency of each mode being the same and the phase difference between the two oscillations being zero, the resultant electric field vector being along the diagonal and in line with the feed corner.

* * * * *